US009604276B2

(12) United States Patent
Stern et al.

(10) Patent No.: US 9,604,276 B2
(45) Date of Patent: Mar. 28, 2017

(54) COUPLER AND METHOD FOR PRODUCTION OF A COUPLER WITH SELECTABLE CONFIGURATION OPTIONS

(71) Applicant: Pennsy Corporation, West Chester, PA (US)

(72) Inventors: Aaron Stern, West Chester, PA (US); Perry Levitt, West Chester, PA (US); Manuel Tavares, Doylestown, PA (US); Zachary Ryan Brook, Leola, PA (US); Wayne H. Murphy, Pottstown, PA (US)

(73) Assignee: PENNSY CORPORATION, West Chester, PA (US)

( * ) Notice: Subject to any disclaimer, the term of this patent is extended or adjusted under 35 U.S.C. 154(b) by 196 days.

(21) Appl. No.: 14/273,140

(22) Filed: May 8, 2014

(65) Prior Publication Data

US 2015/0321679 A1 Nov. 12, 2015

(51) Int. Cl.

| | |
|---|---|
| ***B22C 9/22*** | (2006.01) |
| ***B61G 1/00*** | (2006.01) |
| ***B22C 3/00*** | (2006.01) |
| ***B22D 25/02*** | (2006.01) |
| ***B61G 3/04*** | (2006.01) |
| ***B22C 21/14*** | (2006.01) |

(52) U.S. Cl.

CPC ..... *B22C 9/22* (2013.01); *B22C 3/00* (2013.01); *B22C 21/14* (2013.01); *B22D 25/02* (2013.01); *B61G 1/00* (2013.01); *B61G 3/04* (2013.01)

(58) Field of Classification Search

CPC .... B61G 3/00; B22C 3/00; B22C 9/00; B22C 9/22; B22D 25/02

See application file for complete search history.

(56) References Cited

U.S. PATENT DOCUMENTS 461,312 A 10/1891 Brown
533,985 A 2/1895 Brown
(Continued)

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.

(Continued)

*Primary Examiner* — Zachary Kuhfuss

(74) *Attorney, Agent, or Firm* — John F. A. Earley, III; Frank J. Bonini, Jr.; Harding, Earley, Follmer & Frailey, P.C.

(57) ABSTRACT

A process for producing a coupler and an improved coupler are provided. The process produces a coupler by constructing a mold that is a replica of the coupler and is constructed from a plurality of mold components that are selected and assembled to form a mold having the shape of the coupler. The mold components may include a front mold component section that forms the head of the coupler, a rear mold component section that forms the shank of the coupler, and, optionally one or more shelf components forming a shelf of the coupler. The front, rear and shank mold components may themselves be made from a plurality of mold components that are assembled together. The mold is formed from a consumable material, coating with a heat resistant material so that the assembled mold components are within a mold volume, and molten metal is added to the mold volume.

78 Claims, 8 Drawing Sheets

(56) References Cited

U.S. PATENT DOCUMENTS

| | | | |
|---|---|---|---|
| 693,998 | A | 2/1902 | Brown |
| 2,088,135 | A | 7/1937 | Johnson et al. |
| 2,562,504 | A | 7/1951 | Metzger |
| 2,689,051 | A | 9/1954 | Kayler |
| 3,604,569 | A | 9/1971 | Kulieke |
| 3,670,901 | A | 6/1972 | Metzger |
| 3,722,708 | A | 3/1973 | Ion et al. |
| 3,779,397 | A | 12/1973 | De Penti |
| 3,854,599 | A | 12/1974 | Day et al. |
| 3,856,156 | A | 12/1974 | Metzger |
| 4,081,082 | A | 3/1978 | Scherrer et al. |
| 4,090,615 | A | 5/1978 | Martin |
| 4,024,958 | A | 6/1980 | Kaim |
| 4,537,304 | A | 8/1985 | Kaim et al. |
| 4,591,059 | A | 5/1986 | Hammarlund |
| 4,605,133 | A | 8/1986 | Altherr |
| 4,645,085 | A | 2/1987 | Hanula et al. |
| 5,096,076 | A | 3/1992 | Elliott et al. |
| 5,320,229 | A | 6/1994 | Mautino et al. |
| 5,511,676 | A | 4/1996 | Holmes |
| 5,582,307 | A | 12/1996 | Hawthorne et al. |
| 5,878,897 | A | 3/1999 | Lazzaro et al. |
| 5,900,082 | A | 5/1999 | Hewitt |
| 5,954,212 | A | 9/1999 | Beatty et al. |
| 6,129,227 | A | 10/2000 | Openchowski et al. |
| 6,155,442 | A | 12/2000 | Wurzer et al. |
| 6,796,448 | B1 | 9/2004 | Wilt et al. |
| 7,302,994 | B2 | 12/2007 | Mautino et al. |
| 7,337,826 | B2 | 3/2008 | Mautino et al. |
| 7,757,871 | B2 | 7/2010 | Mautino et al. |
| 8,056,741 | B2 | 11/2011 | Mautino et al. |
| 8,196,762 | B2 | 6/2012 | Smerecky |
| 8,201,613 | B2 | 6/2012 | Marchese et al. |
| 8,297,455 | B2 | 10/2012 | Smyth |
| 8,381,923 | B2 | 2/2013 | Smyth |
| 8,408,406 | B2 | 4/2013 | Smerecky et al. |
| 8,485,371 | B2 | 7/2013 | Nibouar et al. |
| 8,544,662 | B2 | 10/2013 | Smerecky et al. |
| 2004/0173555 | A1 | 9/2004 | Wilt et al. |
| 2005/0093364 | A1* | 5/2005 | Li ..... B60B 35/003 301/124.1 |
| 2008/0128377 | A1 | 6/2008 | Mautino et al. |
| 2009/0289024 | A1 | 11/2009 | Nibouar et al. |
| 2010/0326943 | A1 | 12/2010 | Mautino et al. |
| 2011/0024379 | A1 | 2/2011 | Ely |
| 2011/0068077 | A1 | 3/2011 | Smyth |
| 2011/0163059 | A1 | 7/2011 | Gagliardino et al. |
| 2011/0168655 | A1 | 7/2011 | Nibouar et al. |
| 2012/0292279 | A1 | 11/2012 | Wilt et al. |
| 2013/0042785 | A1 | 2/2013 | Schmidt et al. |
| 2014/0076193 | A1 | 3/2014 | Brook et al. |
| 2014/0262107 | A1* | 9/2014 | Hanrahan ..... B22C 9/043 164/34 |

OTHER PUBLICATIONS

A. Kahn and B.K. Chen, "Evaluation of Grade 1 Austempered Ductile Iron For Application to Rail Cast Components", Proceedings of the Fifth Asia Pacific Industrial Engineering and Management Systems Conference 2004.

Luís Magalhães, Jorge Seabra, "Teeth Surface Failures in Austempered Ductile Iron (ADI) Gears", Gears and Transmission Workshop, Paper No. XIII, p. 269-286, Faculdade de Engenharia da Universidade do Porto, Portugal, Jun. 5, 2003.

Stokes, B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, p. 15-20.

Bubenko et al.; "Fatigue Crack Propagation Within the Austempered Ductile Iron Microstructure"; Acta Metallurgica Slovaca, vol. 17, 2011, No. 1, p. 18-25.

Dundar, Sacit; "Application of Austempered Ductile Iron to Rail Wheel Sets"; Journal of Engineering Sciences 2003, 9 (3), p. 283-287.

International ADI and Simulation Conference; May 28-30, 1997.

Knuckles, Types E and F—Fatigue Test, AAR Manual of Standards and Recommended Practices Castings, 2009, [M-216] 1-2.

SAIFoundry; "Austempered ductile iron production properties"; http://www.slideshare.net/SAIFoundry/austempered-ductile-iron-production-properties-applications#; Mar. 19, 2012.

* cited by examiner

COUPLER AND METHOD FOR PRODUCTION OF A COUPLER WITH SELECTABLE CONFIGURATION OPTIONS

CROSS-REFERENCE TO RELATED APPLICATIONS

The benefits under 35 U.S.C. §§119(e), 120, 121 of the following are hereby claimed: U.S. application Ser. No. 14/171,700, filed on Feb. 3, 2014, the complete contents of which are incorporated herein by reference.

BACKGROUND OF THE INVENTION

1. Field of the Invention

This invention relates generally to railway vehicle coupler assemblies and more particularly to an improved method for producing a coupler and an improved coupler.

2. Brief Description of the Related Art

Railway couplers, particularly those utilized for railway freight cars or vehicles have a coupler body which is an integral casting of a coupler head and a shank. The head of the shank may be an AAR Standard Type "E" or "F" Coupler Head. The head also carries a knuckle and includes a lock, a thrower, a pivot pin and an articulated lock assembly. The coupler is made from a casting formed from low alloy steel. Although there are AAR standards for couplers, the length of the shank from the butt end of the coupler to the location where the shank joins the head may vary. The coupler is designed to be installed on a draft yoke of a railway vehicle. The butt end of the coupler shank is a spherical surface and bears against the face of the front follower of the yoke. The coupler is pivotally mounted on a yoke with a pin that joins the coupler to the vehicle's draft yoke.

Railcar couplers are disposed at each end of a railway car to enable joining one end of such railway car to an adjacently disposed end of another railway car. Couplers generally carry a knuckle which is pivotally mounted on the coupler head and is designed to engage with another knuckle carried on an adjacent coupler or another car.

Typically, couplers are heavy shafts that extend from each rail car. Generally, each coupler is engaged with a yoke housing a shock-absorbing element referred to as the draft gear. The type-E coupler is the standard coupler for railway freight cars. The type-E coupler has standard specifications such that producers making a type-E coupler adhere to a standard specification, so that the standard railway car couplers are completely interchangeable, regardless of the manufacturer. In addition, adherence to a standard also enables couplers from any one manufacturer to be able to be readily joined to couplers from any other domestic manufacturer. The Association of American Railroads ("AAR") has adopted standards for railway couplers. The coupler must include specific geometry and dimensions that allow it to receive a knuckle, and the geometry must be such that the knuckle is allowed to freely operate when coupling and uncoupling railway cars. These dimensions and features of the coupler may be checked for compliance with AAR standards by using gauges, which are applied to the coupler to verify the coupler dimensions or parameters are within an allowable variation or tolerance range.

Couplers have a particular life, and in instances may fail. In many cases when a railcar coupler fails, a replacement coupler must be carried from the locomotive at least some of the length of the train, which may be up to 25, 50 or even 100 railroad cars in length. The repair of a failed coupler can be labor intensive, can sometimes take place in very inclement weather and can cause train delays.

The production of couplers involves a method known as sand casting or "green sand" method, where a flask which is a box having an open top and open bottom, is filled with sand around a pattern which is a component (such as a wood piece) that is used to make the impression in the sand. The green sand casting process involves a number of components and steps, as a flask or box must be created with cope and drag sections, so that the pattern may make an impression in the sand and can be removed from the mold prior to introduction of the molten metal therein. A mold may include additional components, such as, for example a gate and one or more runners through which the molten metal is admitted to one or more parts of the impression formed by the pattern. Gates and runners generally are formed similar to the mold impression, for example, with a component, such as wood (e.g., a gate and runner pattern), and are removed prior to the introduction of the molten metal, often with the removal of the pattern. A path of entry, such as an opening for admission of molten material is generally made through a sprue which is a communication path leading to the gate. The gate generally receives the molten metal that is poured through the sprue opening, and the runners act as conduits through which the molten metal flows to the impression or mold space formed by the pattern. In the case of forming a coupler, the mold must further be provided with cores. Cores are generally made from a material that remains present in the molding process during the mold melt introduction and are removable thereafter. In some cases, the configuration of the pattern or ultimate coupler part does not allow for removal of a core in its solid form, so it must therefore be broken apart and removed in pieces. The cores generally also may be made from green sand. The "green sand" method involves baking the mold so that the sand will form a mass and stay together during the molding process, and, in particular, when the molten metal is introduced into the mold. Once the molten metal is introduced into the mold through the sprue, gate and runners, the molten metal flows around the open areas of the mold and is blocked from entry to areas of the mold that are occupied by cores. The placement and positioning of cores in the mold, as well as the ability for a core to remain in place is required in order to produce a usable coupler. Although attempts are made to secure the core in a proper position, the cores have been known to shift prior to or during receiving the melt. In instances where a core shifts or where the green sand is not completely amassed together (e.g., where portions break off leaving fractured or missing edges), the coupler produced may need to be scrapped.

SUMMARY OF THE INVENTION

According to a preferred embodiment, a method for producing couplers and an improved coupler are provided. The method involves the construction of a coupler from selected mold components. The mold components are selected and the mold is constructed by assembling together the mold components. Once constructed, the material forming the coupler such as molten metal or the melt is introduced to the mold formed from the assembled mold components. The method does not require the use of cores and therefore, the potential for core shifting is eliminated. In addition to not requiring the use of cores, baking out of the green sand also is not required. In addition, as traditionally, couplers produced using the green sand method required impressions to be made using a pattern, and assembling cope and drag sections of a mold around the pattern, the present invention provides a method for producing a coupler from a plurality of mold components, where the mold components may be assembled to provide selected features for the coupler to be produced. For example, the method includes selecting a shank from multiple shank portions that are available for the mold assembly.

Couplers are produced with alternate options for the coupler head and shank portions as well as for the upper shelf and lower shelf. According to one embodiment, the coupler that is produced includes an upper shelf and a lower shelf that may be selected from one or more shelf options for couplers that are constructed to have one or more shelves. In addition, embodiments also include a shank portion that may be selected from one or more shank portions (such as, for example, from a plurality of shank configurations to provide a shank suitable for the application to which the coupler is to be used, e.g., freight car, rotary car, locomotive). Although a preferred coupler head embodiment is illustrated, additional embodiments of the method for producing a coupler provide for the selection of a coupler head portion from a selection of one or a plurality of head configurations (such as, for example, from one or more type-E head configurations and/or from one or more type-F configurations).

According to preferred embodiments, a coupler is formed according to a process where mold components are constructed and assembled to replicate the coupler shape. Preferably, the mold that is constructed from the assembled mold components is a replica of the coupler to be produced. According to a preferred embodiment, the mold components preferably include a coupler shank component, a coupler head component, a coupler upper shelf and coupler lower shelf component. The coupler mold components may be provided as a plurality of components. According to one example, the coupler mold may be made from four components, as described, for example, where each mold component replicates a respective coupler portion, such as, the upper shelf, lower shelf, head and shank. Alternately, the mold components forming the coupler may be greater or fewer in number, such as, for example, a plurality of mold components may be used to construct the head of the mold and a plurality of mold components may be used to construct the shank of the mold.

It is an object of this invention to provide an improved coupler for a railway vehicle.

It is another object of the invention to provide a method for producing a coupler.

It is an object of the invention to provide a coupler that is lightweight and suitably strong to handle forces and loads imparted on the coupler when in use installed on a railway vehicle.

It is another object of the invention to provide a mold and a production method for producing couplers from an assembly of a plurality of mold component parts that may be used to form a coupler having a selected head design and a selected shank design, and selected upper and lower shelves.

It is another object of the invention to provide a mold and production method where a plurality of selection options are made available for one or more of the coupler portions, such as, for example, a head selection option, a shank selection option, and shelf selection options, where the method involves making a selection from the options for a desired coupler to be produced, and where the method includes producing a mold from the selections, and producing a coupler from the mold having a configuration corresponding to the selected options. The selection options may correspond to a single mold component (e.g., where one mold component is used to replicate the shank and is assembled together with other mold components, such as the mold component or those mold components replicating the head) or may correspond with a plurality of mold components (where more than one mold component is used to replicate the shank, the mold components being assembled together to replicate the shank, and being further assembled with one or more components forming the head).

It is another object of the invention to provide a method for producing couplers, where the couplers produced are constructed to meet standard specifications as set forth by the Mechanical Committee of Standard Coupler Manufacturers and/or the AAR.

BRIEF DESCRIPTION OF THE DRAWING FIGURES

Figure 8:
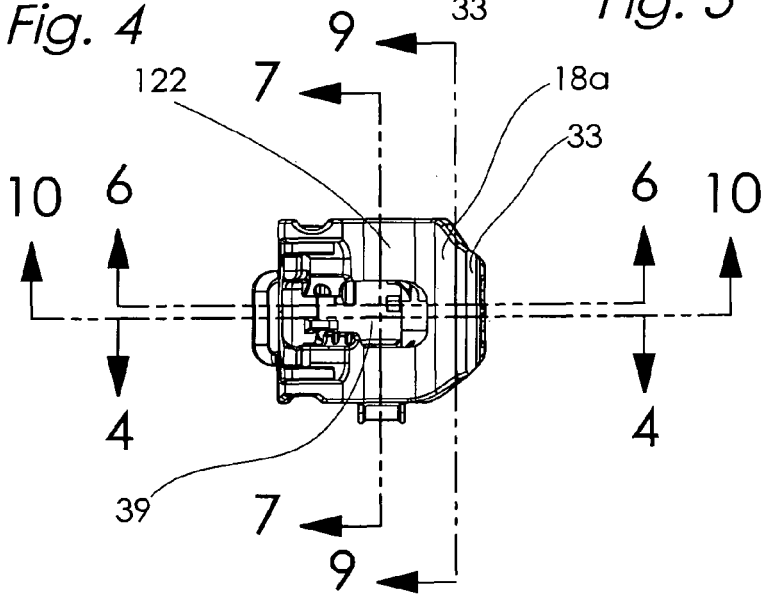
FIG. 8 is a front elevation view of the coupler head mold component of FIG. 2.
Figure 7:
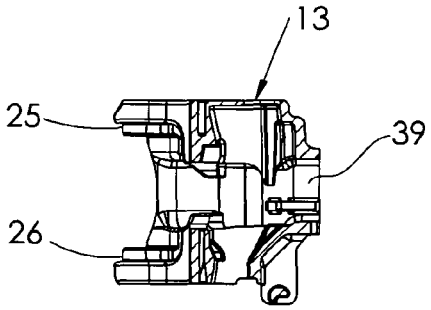
FIG. 7 is a sectional view of the coupler head mold component of FIG. 2, taken along the section line 7-7 of FIG. 8.
Figure 2:
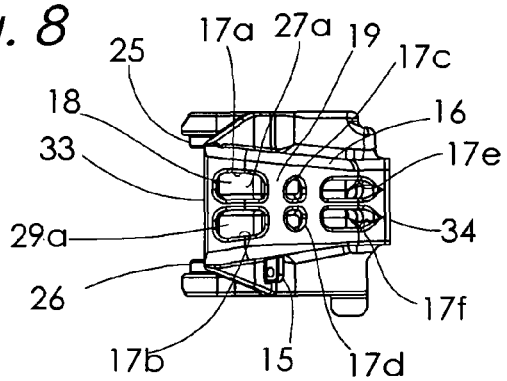
FIG. 2 is a left side elevation view of the front or coupler head mold component of FIG. 1, shown separately from the other mold components.
Figure 9:
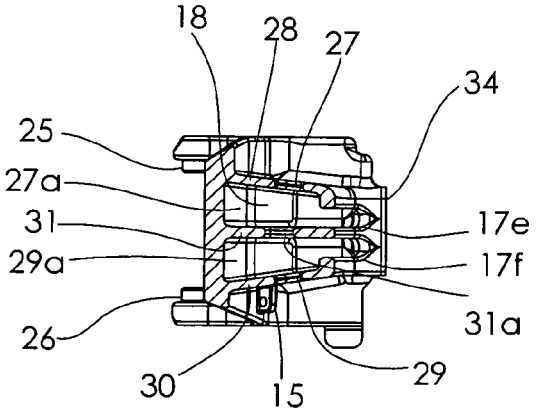

FIG. 9 a sectional view of the coupler head mold component of FIG. 2, taken along the section line 9-9 of FIG. 8.

Figure 10:
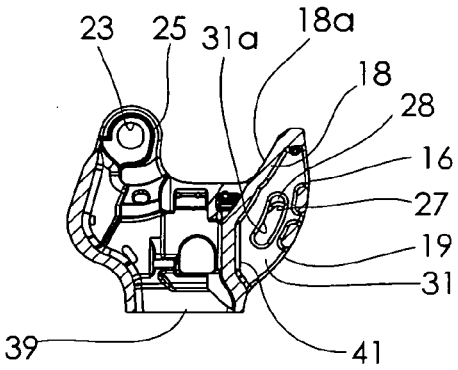

FIG. 10 is a sectional view of the coupler head mold component of FIG. 2, taken along the section line 10-10 of FIG. 8.

Figure 11:
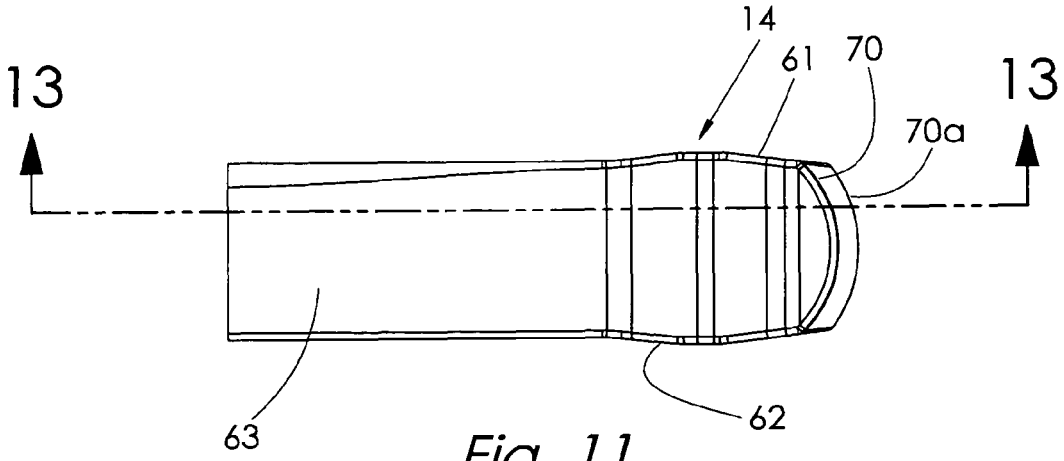

FIG. 11 is a right side elevation view of the rear portion of the coupler shank mold component, shown separately from the other components.

Figure 12:
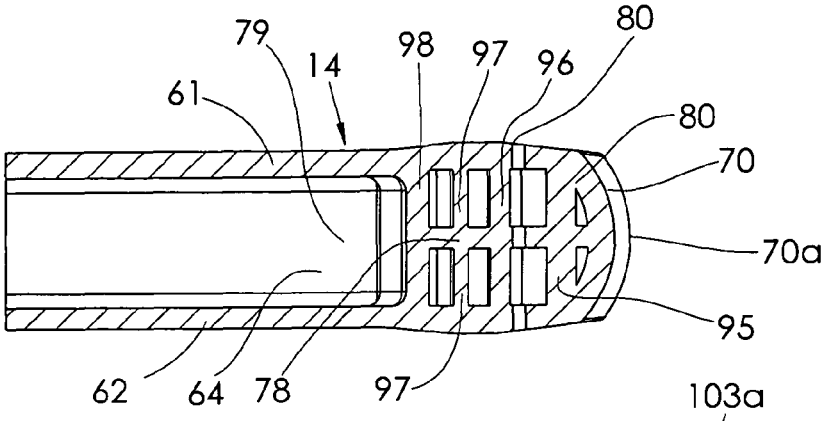
Figure 13:
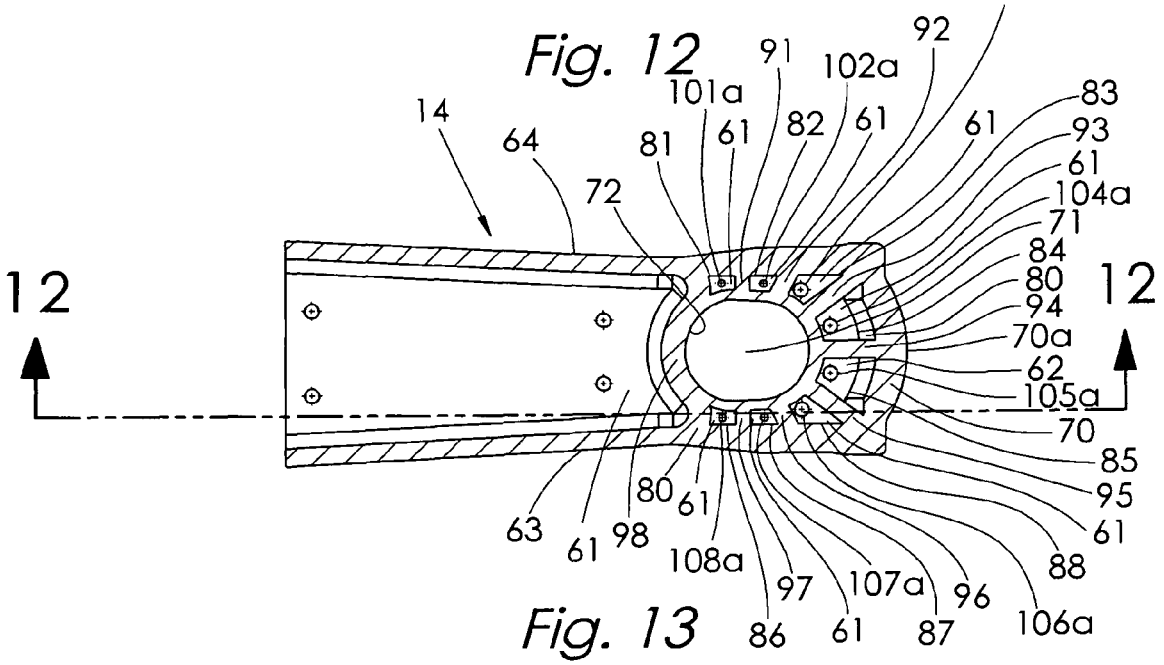

FIG. 12 is a sectional view of the coupler shank mold component of FIG. 11, taken along the section line 12-12 of FIG. 13.

FIG. 13 is a sectional view of the coupler shank mold component of FIG. 11, taken along the section line 13-13 of FIG. 11.

Figure 14:
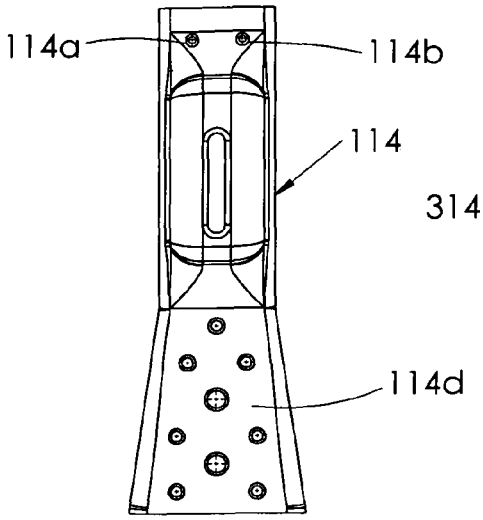
Figure 15A:
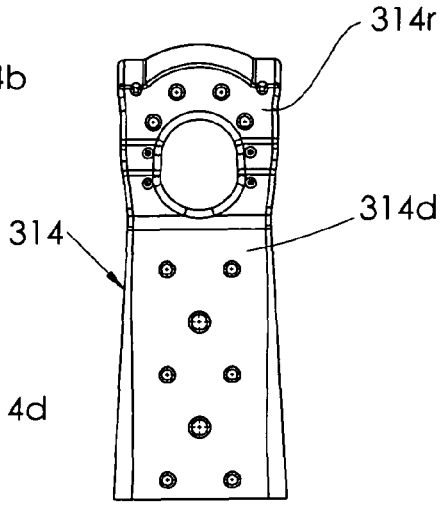
Figure 15D:
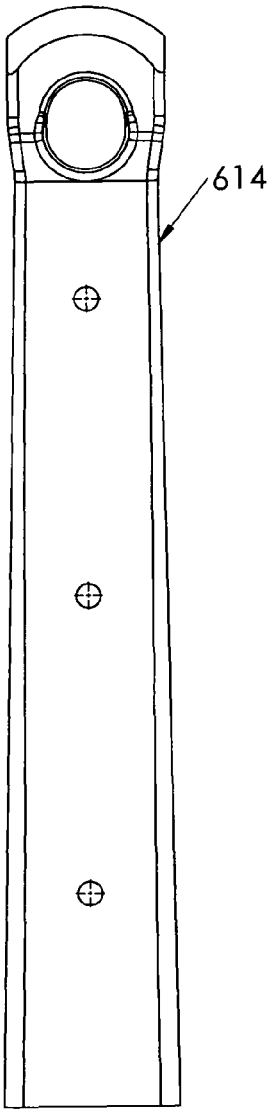
Figure 15B:
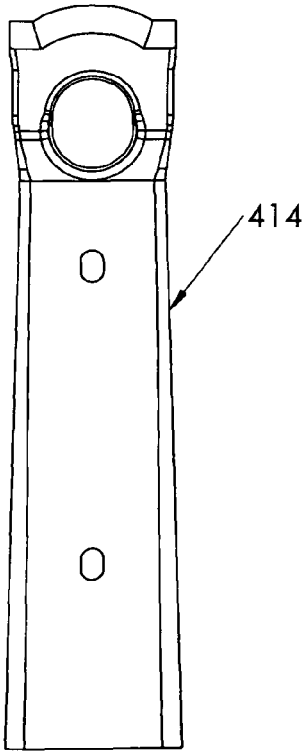
Figure 15C:
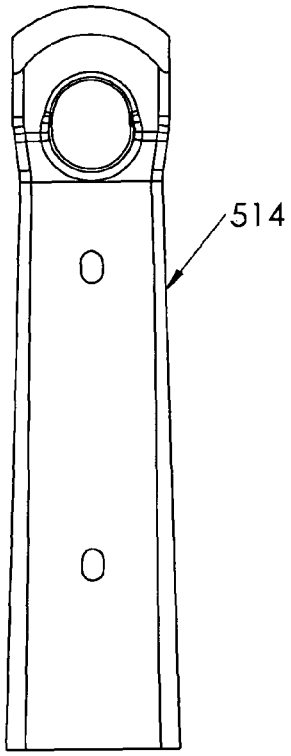
Figure 16A:
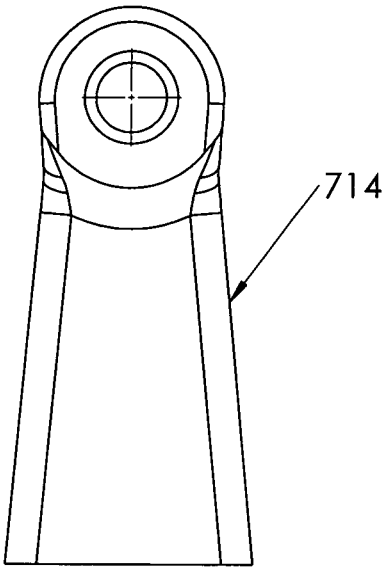
Figure 16B:
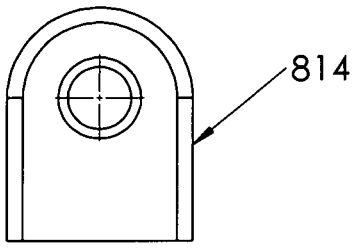
Figure 16C:
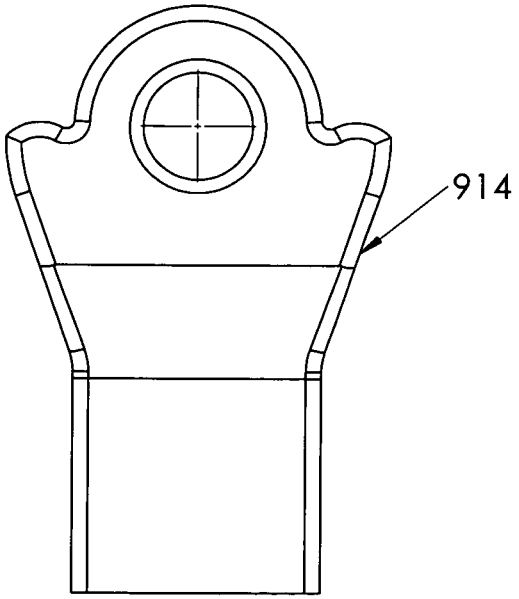
Figure 16D:
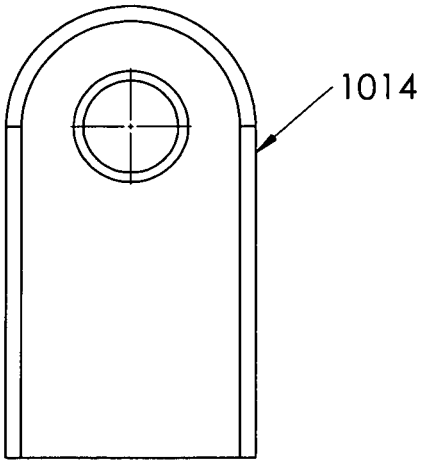

FIG. 14 is a top plan view of an example of an alternative selection option for the coupler shank, and shows an alternate shank mold component for a type-E shank.

FIGS. 15*a*,15*b*,15*c*,15*d* are top plan views of examples of alternative selection options for the coupler shank, and show alternate shank mold components for type-F shanks.

FIGS. 16*a*, 16*b*, 16*c*, 16*d* are top plan views of examples of alternative selection options for the coupler shank, and show alternate shank mold components for locomotive shanks.

Figure 1:
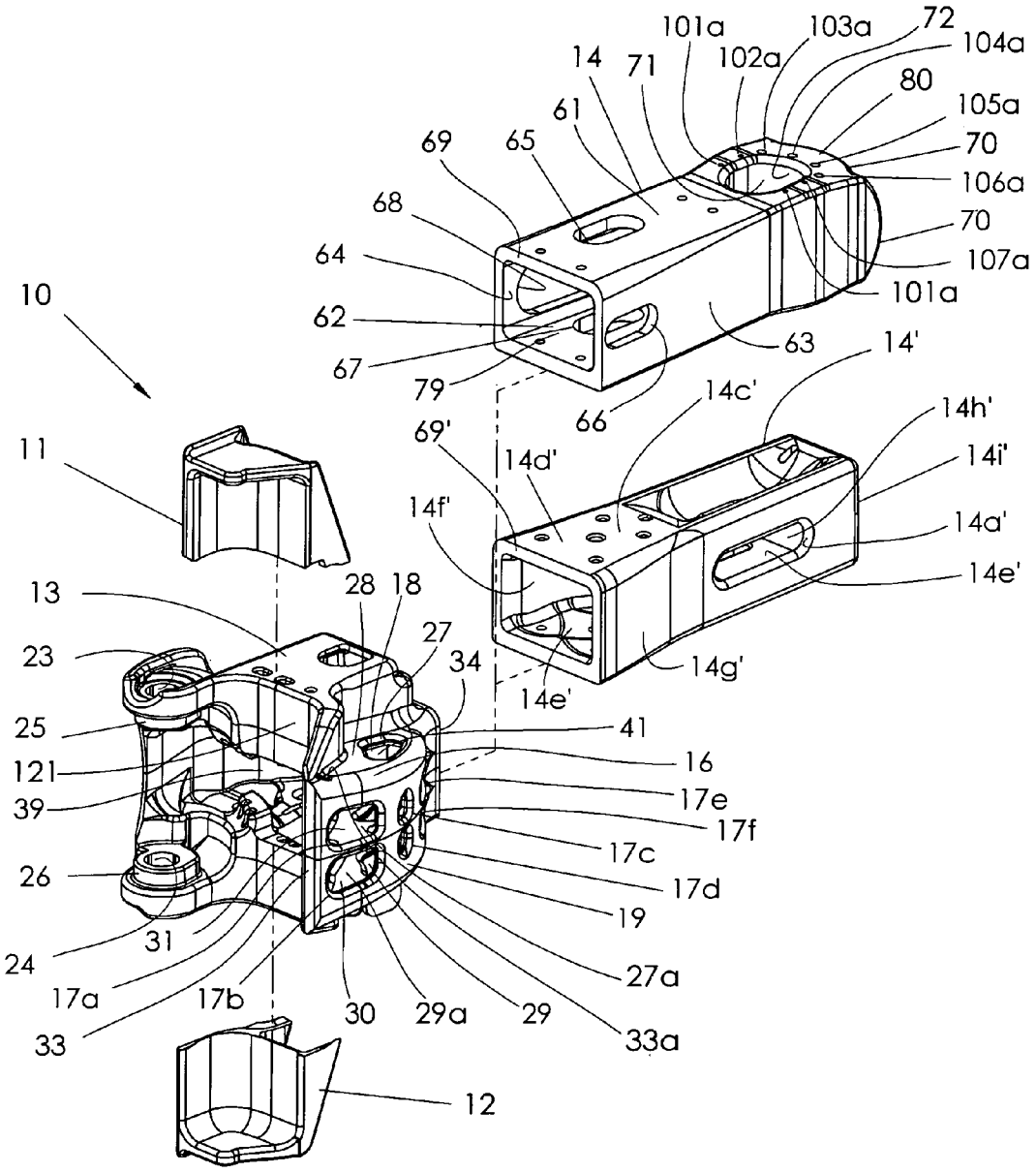
FIG. 1 is a perspective view showing an embodiment of a mold for producing a coupler, the mold being shown with the mold components in an unassembled condition.
Figure 4:
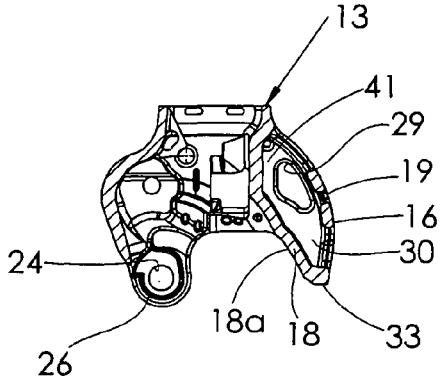
FIG. 4 is a sectional view of the coupler head mold component of FIG. 2, taken along the section line 4 of FIG. 8.
Figure 5:
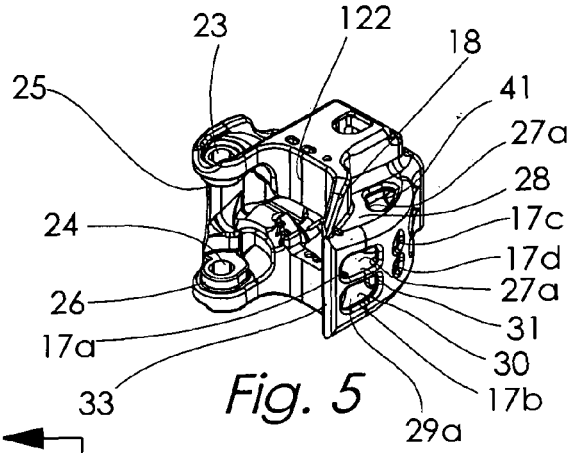
FIG. 5 is a perspective view of the coupler head mold component of FIG. 2, as viewed from the front, looking down from the top of the left side thereof.
Figure 17:
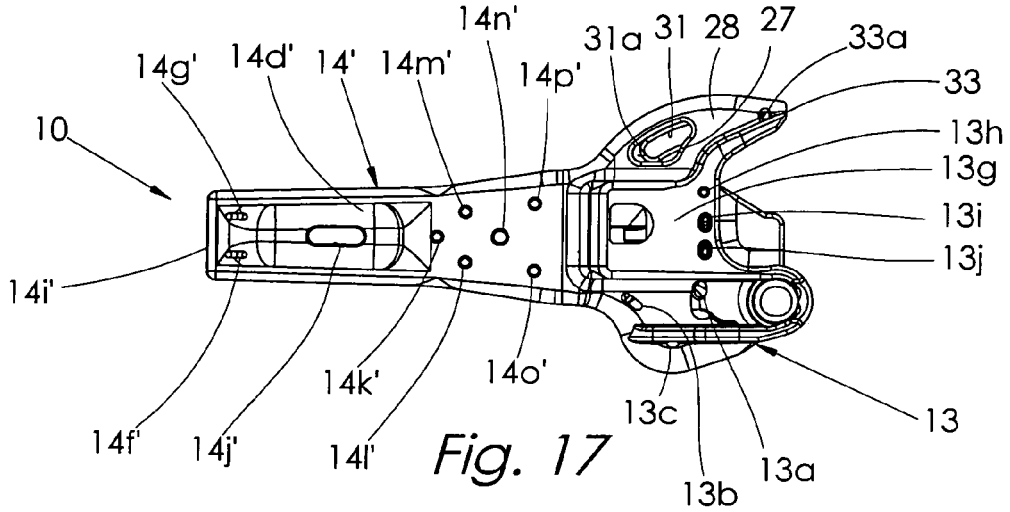

FIG. 17 is a top plan view of an assembled mold constructed from the mold component parts shown in FIG. 1 (shown without the top and bottom shelf components).

Figure 18:
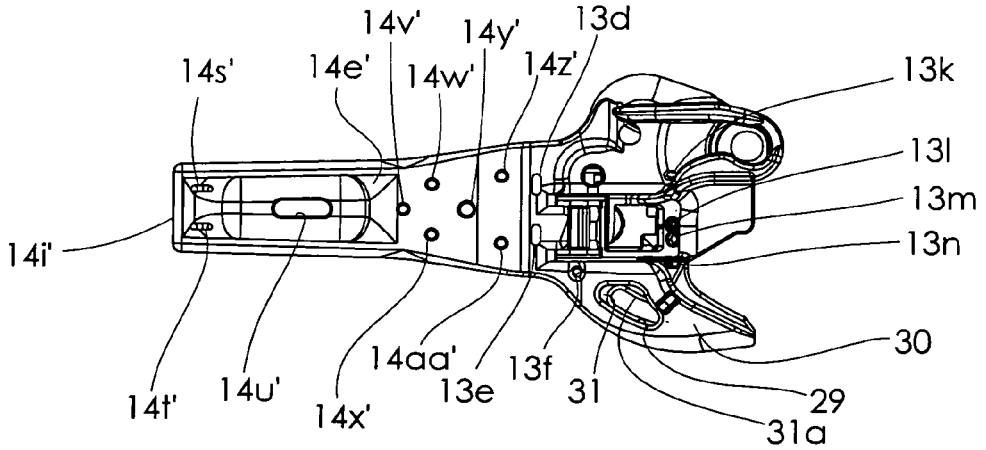

FIG. 18 is a bottom plan view of the assembled mold shown in FIG. 17, illustrated with the lower shelf attached.

Figure 19:
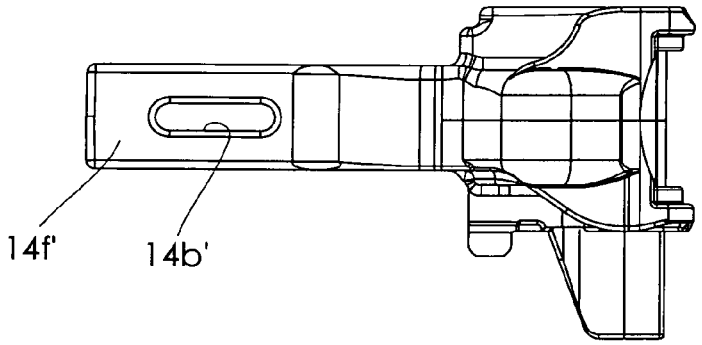

FIG. 19 is a right side elevation view of the assembled mold shown in FIG. 17.

Figure 20:
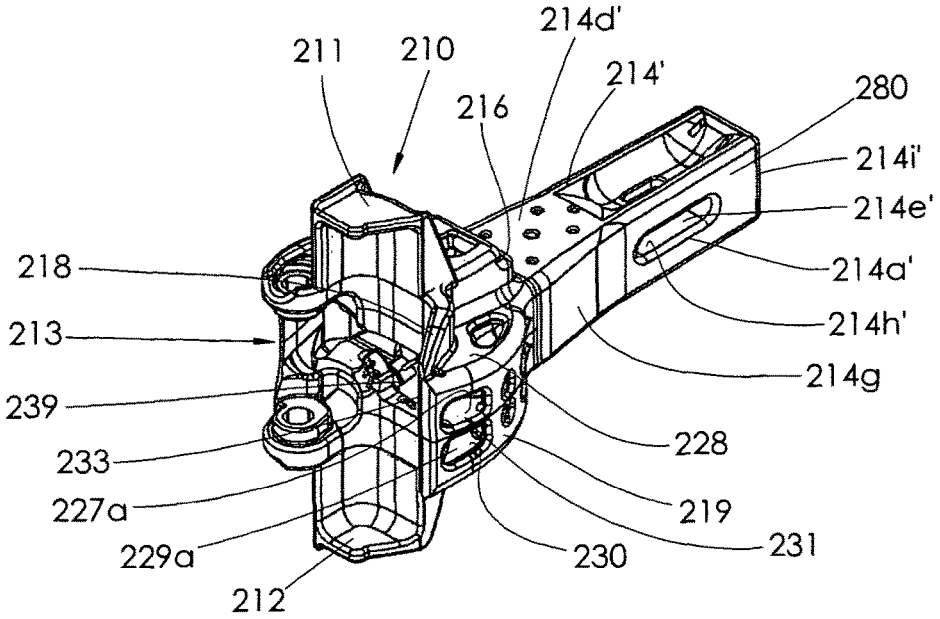

FIG. 20 is a perspective view of a coupler produced from the mold shown in FIGS. 1-13 and 17-19.

Figure 21:
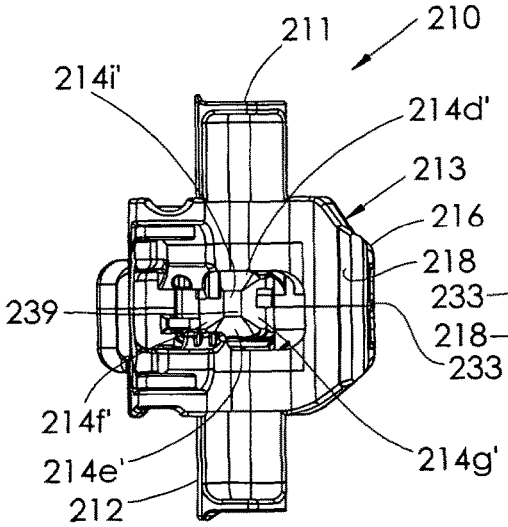

FIG. 21 is a front elevation view of the coupler of FIG. 20.

Figure 22:
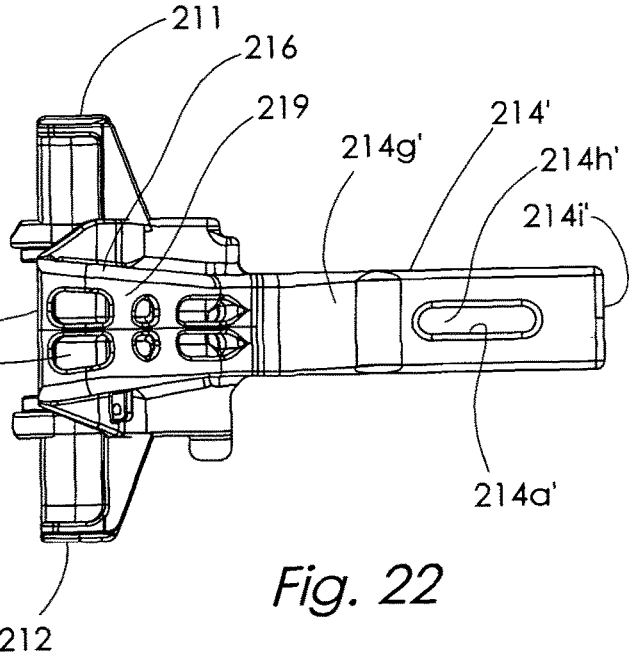

FIG. 22 is a left side elevation view of the coupler of FIG. 20.

DETAILED DESCRIPTION OF THE INVENTION

A method for producing a coupler and an improved coupler are provided. Referring to FIGS. 1-19, there are illustrated a mold and mold components that are provided and used for constructing couplers. The method is discussed using an illustration of an exemplary embodiment of a mold 10 for producing a coupler 210 (FIGS. 20-22). The figures depict examples of some possible alternate mold components that may be used to construct a mold and produce a coupler according to the method discussed herein, such as, for example the method discussed in connection with the mold 10 and coupler 210. The mold 10 is depicted in FIGS. 1-13 showing a preferred example of the mold components and is depicted as an assembled mold in FIGS. 17-19. Preferably, the mold 10 may be used to form the coupler 210 shown in FIGS. 20-22 and described herein.

A coupler may be produced by constructing a mold assembled from mold components that replicate the features desired for the coupler to be produced. A plurality of selection options are made available for one or more of the coupler portions, such as, for example, a head selection option, a shank selection option, and shelf selection options. According to preferred embodiments, the method involves making a selection from the options for a desired coupler to be produced. The selected options correspond with mold components that replicate the selections for the coupler. A mold which is a replica of the coupler to be produced, based on the selections made, is produced from the selections. A coupler is produced using the mold, and the coupler produces has a configuration corresponding to the selected options. The selection options may correspond with a single mold component or multiple mold components. For example, according to one embodiment, one mold component may be used to replicate the shank and is assembled together with other mold components, such as the mold component or those mold components replicating the head. According to another embodiment, the shank portion of the mold may be replicated using a plurality of mold components, for example, where more than one mold component is used to replicate the shank. In the latter case, the mold is constructed by assembling the mold components together to replicate the shank, and further assembling together the shank mold components with one or more components forming the coupler head of the mold.

For illustrative purposes a mold 10 is depicted and described herein in connection with the method. The mold 10 preferably is formed to resemble the shape of the coupler that is to be produced using the mold 10. The mold 10 preferably also corresponds with the volume that forms the mass of the coupler produced with the mold 10. According to preferred embodiments, a mold for producing a coupler may be constructed from a plurality of sections that may be assembled together to form the mold. According to the embodiment shown, the mold 10 is constructed from a plurality of mold component sections, and, according to a preferred exemplary embodiment, four mold component sections are shown to construct the coupler mold 10, including an upper mold component section 11, a lower mold component section 12, a front component section 13, and a rear component section 14,14', are provided. The rear component section 14,14' is shown providing two different shanks for a coupler to be produced using the mold. The rear component sections 14, 14' represent shank options for the coupler to be produced. A shank option is selected, and one of the rear component sections 14,14' is used in conjunction with other mold components to form a coupler. Referring to FIG. 14, an alternate embodiment of a shank mold component 114 is shown as an example of a further alternative shank option that may be used. The shank mold component 114 is a type-E shank and may be assembled to form a mold, such as, the mold 10 shown and described herein, where the alternate shank component 114 is an alternative selection in place of the shank 14 or 14'. As with the other mold components, the shank 114, although depicted as a single mold component may be constructed from a plurality of mold components that are assembled together to form the shank 114. Similar to the shank 114, further alternatives that may be selected for the coupler shank, in addition to the type-F shank 14 depicted in FIG. 1, are the type-F shank mold components 314, 414, 514, 614 depicted in FIGS. 15*a*,15*b*,15*c*,15*d*. The coupler also may be constructed as a locomotive coupler. The mold may be configured to have a shank mold component that corresponds with a locomotive shank. Referring to FIGS. 16*a*,16*b*,16*c*,16*d*, alternative shank mold components are illustrated as locomotive shank components 714,814,914,1014, respectively. As with the other mold components, including the mold component shank portions, the shank mold components 314, 414, 514, 614,714,814,914,1014 although depicted as a single component or an assembled component, may be constructed from a plurality of components, which when assembled form the shank mold component portion of the mold.

Although reference herein is made to a number of shanks and shank mold components, and a number are illustrated in the figures herein only one rear or shank coupler mold component section 14' is used to construct the mold 10, though the shank mold component section 14' may itself be constructed from a plurality of sections. Although the upper mold component section 11 and lower mold component section 12 and front or head mold component section 13 are not shown with alternate options, the upper and lower shelves, as well as the head, may be provided having alternate shapes from which to make a selection. For example, an upper shelf, a lower shelf, a coupler head and shank may be selected for a desired coupler. The coupler may be produced by constructing a mold that includes the desired respective portions making up the desired coupler, and assembling those portions, for example, the mold component sections shown 11,12,13,14', to form a coupler mold, such as, for example, the mold 10. The mold 10 is a replica of the coupler to be produced, as shown in FIGS. 20-22.

Mold component sections forming the coupler, such as the mold component sections 11,12,13,14', are produced in accordance with a suitable process which may include, injection molding, three-dimensional (3-D) printing, carving or other suitable forming procedure. The mold component sections or mold components 11,12,13,14' preferably are formed from a consumable material, such as, for example, decomposable material. According to a preferred embodiment, the decomposable material is a material that will decompose to gaseous or other product or products when contacted with the material that is used to form the coupler. Preferably, the material used for forming the coupler is a metal material, and may comprise steel or other suitable metal, alloy or mixture of metals. According to a preferred embodiment, the material used for forming the coupler may be an austempered metal. The decomposable mold material preferably is a material that is lightweight and low in mass, and does not interfere with the formation of, or the finished coupler. The material used for forming the coupler with the mold 10 generally is supplied to the mold 10 as a molten material or melt.

According to a preferred embodiment, the mold component sections 11,12,13, 14' are arrangeable together to form a representation of the shape of the coupler to be produced. The mold 10 is configured having a plurality of mold component sections forming the mold, which, in the embodiment illustrated, includes an upper component 11 corresponding to an upper shelf of a coupler, a lower component 12 corresponding to the coupler lower shelf, a front component 13 corresponding to the coupler head, and a rear component 14' corresponding to the coupler shank. The components 11,12,13,14' preferably are assembled to produce a mold 10 having a cavity therein. According to a preferred embodiment, the mold 10 preferably, when assembled from the mold components 11,12,13,14', has at least one, and preferably, a plurality of cavities.

Figure 3:
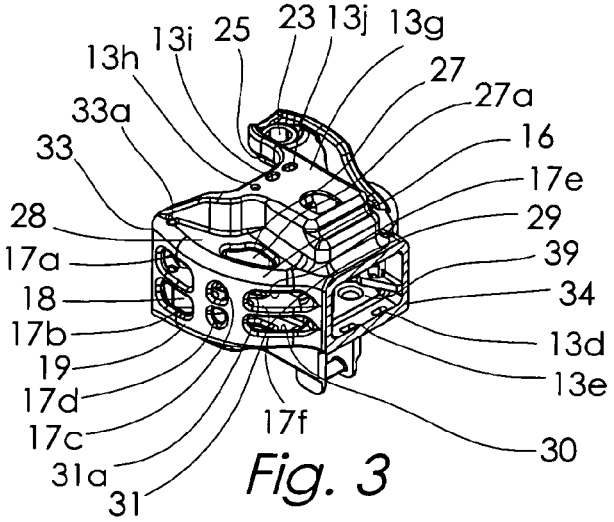
FIG. 3 is a perspective view of the coupler head mold component of FIG. 2, as viewed from the rear, looking down from the top of the left side thereof.
Figure 6:
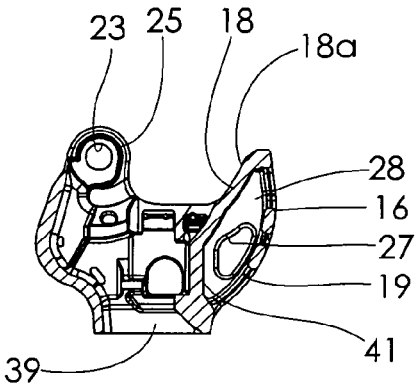
FIG. 6 is a sectional view of the coupler head mold component of FIG. 2, taken along the section line 6-6 of FIG. 8.

According to the preferred embodiment illustrated, the mold component sections 11,12,13,14' are arranged together to form a plurality of cavities. A mold component front portion or coupler head portion 13 preferably is selected based on the configuration of the coupler head desired to be produced. In the example illustrated, the coupler head is selected and the front mold component 13 corresponds with the coupler head. The front mold component or head component 13 is shown having a guard arm portion 16 with a first plurality of openings 17*a*,17*b*,17*c*,17*d*,17*e*,17*f* (FIG. 2) shown formed in the guard arm wall 19. As best shown in FIG. 2, the mold 10 also includes a chain lug 15 provided on the front mold component 13. Although the chain lug 15 is shown located below the guard arm portion, according to some alternate embodiments, chain lugs in some couplers may be located on a coupler lock chamber. The mold 10 also is shown having a first angled gathering surface 18*a* provided on the front mold component section 13 on the gathering wall 18. The exemplary coupler mold 10 is shown having a plurality of cavities provided in the guard arm 16. A plurality of openings preferably are provided in the front or head component 13. Referring to FIGS. 1 and 3, an upper opening 27 is provided in the top surface or upper wall 28 of the guard arm 16. According to a preferred embodiment, an opening 29 is provided in the lower surface or bottom wall 30. The openings 27,29 may be defined by one or more interior side walls, such as for example, the inner cavity side wall 41 and guard arm gathering face wall 18, as well as by the upper wall 28 and lower wall 30. The openings 17*a*, 17*b*,17*c*,17*d*,17*e*,17*f* in the guard arm side wall 19 preferably are bordered by a portion of the side wall 19. Referring to FIG. 9, according to a preferred embodiment, the mold 10 is constructed having a plurality of cavities in the head portion 13, and preferably a plurality of the cavities are formed in the guard arm 16, including an upper guard arm cavity 27*a* and a lower guard arm cavity 29*a*. The upper and lower guard arm cavities 27*a* and 29*a* preferably form the guard arm interior space. According to a preferred embodiment, the mold 10 is constructed with a mid wall portion 31 spanning between the guard arm gathering face wall 18 and the guard arm side wall 19. The mid wall portion 31 preferably, along with the upper wall 28, defines the upper cavity 27*a* and with the lower wall 30 defines the lower cavity 29*a*. The mid wall portion 31, as shown in FIG. 10, preferably includes an opening 31*a* therein providing communication between the upper cavity 27*a* and lower cavity 29*a*.

According to a preferred embodiment illustrated, the guard arm portion 16 of the front mold component 13 extends from the coupler nose portion 33 to the rear wall 34 of the mold component 13. The front mold component 13 has a rear wall 34 that is a connecting wall for connecting the front or head mold component 13 with a shank mold component 14' to form the mold 10 (preferably with one or more shelf components, e.g., 11,12). The rear wall 34 defines an opening to a rear cavity 35 of the head or font component 13 which preferably joins with the cavity 14*h'* of the respective shank 14' when the front mold component 13 is connected with a respective shank mold component 14'.

The coupler head mold component 13 further includes pivot pin openings, including an upper pivot pin opening 23 and a lower pivot pin opening 24, and pivot lugs, including an upper pivot lug 25 and a lower pivot lug 26. The pivot pin openings 23,24 are provided to receive a knuckle pin (not shown), which is installed in the pivot pin openings 23,24 when a knuckle is seated at the pivot lugs 25,26. The pivot lugs 25,26 and pin, when installed, pivotally retain a knuckle on the coupler head. The mold component 13 preferably is configured with the pivot lugs 25,26 aligned with the respective pivot openings 23,24.

According to some embodiments, the construction is provided so that the construction of the guard arm portion 216 suitably supports the coupler 210, and in particular the portion of the coupler 210 extending between the nose portion 233 and the shank 214' (see FIGS. 17 and 19).

In accordance with a preferred embodiment, the mold 10 includes a rear mold component or shank portion 14'. The rear mold component 14' is configured to correspond with the shape and volume of the shank of a coupler that is to be produced using the mold 10. The shank 14' is depicted separate from the front mold component or head 13. The shank mold component 14 has a top wall 61, a bottom wall 62, a first side wall 63 and a second side wall 64. The top wall 61 is shown having an opening 65 therein. The first side wall 63 includes an opening 66 therein. The bottom wall 62 has an opening 67 therein, and the second side wall 64 has an opening 68 therein. The rear mold component 14 also includes a front wall 69 which is provided to connect with the rear wall 34 of the front mold component 13 that forms the coupler head.

Referring to FIGS. 12-13, the shank 14 is depicted to illustrate a preferred configuration for the interior rear or butt portion. The exemplary shank mold component 14 illustrates a weight reduction zone or feature that may be provided in the shank components, such as, for example the type-F shank mold components 314,414,514,614 depicted in FIGS. 15*a*,15*b*,15*c*,15*d*, respectively. According to some embodiments, the weight reduction zone or feature also may be implemented in the mold and mold components for alternate shank configurations, including, for example, the locomotive shank mold components 714,814,914,1014 depicted in FIGS. 16*a*,16*b*,16*c*,16*d*, respectively. According to a preferred embodiment, the rear mold component or type-F shank component 14 of the mold 10 depicted in FIG. 1 has a rear wall 70 with a spherical face 70*a*, which is formed on the coupler produced by the mold 10 to preferably engage with a complementary spherical face of a follower member. According to embodiments of the invention, the mold 10 may be constructed having the rear section shank 14 configuration applied and used in the construction of couplers, including those couplers shown and described herein. For example, the coupler shank 14 has a bore 71 therein which is adapted to connect to a yoke (not shown) on the end of a center sill of a railway vehicle. The bore 71 preferably is defined by a wall 72. According to preferred embodiments, the wall 72 may span from the top of the bore 71 on the shank top wall 61 to the bottom of the bore 71 on the shank bottom wall 62, and preferably, the bore 71 extends entirely through the coupler shank 14. The shank portion 14 preferably is constructed having a rear weight reduction zone 80 provided at the rear of the coupler shank section 14. The weight reduction zone 80 preferably includes a plurality of cavities and ribs spacing apart the cavities. The cavities preferably may extend between the top and bottom of the shank, and, according to some embodiments, are formed between the top surface 61 and bottom surface 62. According to a preferred embodiment, a weight reduction zone 80 is illustrated with a plurality of cavities 81,82,83,84,85,86,87,88 disposed surrounding the bore wall 72. According to a preferred mold embodiment depicted, the cavities 81,82,83,84,85,86,87,88 are defined by a plurality of ribs 91,92,93,94,95,96,97 which span from the bore wall 72 outwardly toward the first side wall 63, rear wall 70 and second side wall 64, respectively. A connecting wall 98 forms part of the bore wall 72 and connects the first side wall 63 with the second side wall 64. Referring to FIGS. 12 and 13, according to a preferred embodiment depicted where the shank is selected as a type-F shank 14, the cavities 81,82,83,84,85,86,87,88 are defined by a plurality of ribs 91,92,93,94,95,96,97 which span from the bore wall 72 outwardly toward the first side wall 63, rear wall 70 and second side wall 64, respectively. According to a preferred embodiment, each rib 91,92,93,94,95,96,97 preferably includes a first or upper portion, provided above the mid wall 78, and a second or lower portion, provided below the mid wall 78. Preferably, the ribs or rib portions have a first end joining with one of the top wall 61 or the lower wall 62 and have a second end joining with the mid wall 78. According to one embodiment, the weight reduction zone 80 may include a plurality of openings (not shown) formed in the mid wall 78 of the shank 14. As shown in FIGS. 1 and 13, preferably, there are openings or bores 101*a*,102*a*,103*a*,104*a*,105*a*,106*a*,107*a*,108*a* provided in the upper wall 61. Preferably, a plurality of openings (not shown) also may be formed in the lower wall 62, which may be aligned with the openings 101*a*,102*a*,103*a*,104*a*,105*a*,106*a*,107*a*,108*a* in the top wall 61, the openings in the mid wall 78, or both. The mold 10 preferably is constructed to include the openings and cavities shown in FIGS. 12-13 to provide a zone of weight reduction 80 in the butt end of the shank 14. The shank 14 also may include a cavity 79 formed therein between the opening bordered by the front wall 69 (FIG. 1) to the bordering or connecting wall 98 (FIGS. 12 and 13). The cavity 79 preferably communicates with the cavity 39 formed in the head mold component section 13, when the mold 10 is assembled.

Referring to FIG. 1, an alternate embodiment of a shank portion 14' of the mold 10 is shown. Similar to the shank portion 14 shown and described herein, the alternate mold rear component or shank portion 14' has a front wall 69' which is designed to connect with the wall 34 of the head portion 13, when the shank portion 14' and front mold section or head 13 are connected to form the mold 10. The shank component 14' is designed to form a shank of the coupler to be produced from the mold 10, where the coupler shank is to be fitted within and attached to a yoke (not shown). In the configuration illustrated, the shank 14' has a key slot 14*a*' extending laterally through the shank 14' adjacent the butt 14*i*'. A key slot 14*b*' preferably is provided in the opposite shank side wall 14*f* (see FIG. 19). A key (not shown) may extend through the slots 14*a*',14*b*' to secure the coupler formed by the mold 10 to a yoke (not shown). The rear mold component 14' corresponding with the alternate shank portion of the mold 10 preferably is configured having a dimension for the key slots 14*a*',14*b*' that is in accordance with the AAR standards. The exterior dimensions of the shank portion 14' of the mold 10, preferably also may have AAR standard dimensions. According to a preferred embodiment, the mold 10 is formed from the mold shank component 14' or rear mold section which connects with the front mold component or head 13. The shank component 14' of the mold 10 preferably is configured having a box-like front or forward section 14*c*' defined by top and bottom walls 14*d*',14*e*', and opposed side walls 14*f*,14*g*'. The mold component shank 14' top and bottom walls 14*d*',14*e*' may be inwardly angled. According to some embodiments the walls 14*d*',14*e*' may increase in cross-section proximate the key slots 14*a*',14*b*'. According to a preferred embodiment, the shank mold section 14' is constructed having a cavity 14*h*' formed therein, which may extend from the opening bordered by the front wall 69' through the shank 14' to the butt or end of the shank 14*i*' opposite the front wall 69'.

The coupler mold 10 preferably has shelf components, that may include an upper shelf and a lower shelf that may be selected for configuring with the other mold components, such as the front component or head 13 and rear component or shank 14'. Although the mold components are illustrated showing a preferred embodiment of a coupler with a coupler head 13, the shank 14', the upper shelf 11 and lower shelf 12, alternate configurations for the head, shelves, and shanks may be provided and/or constructed with the mold being assembled and used as shown and described herein. Examples of further shank options are illustrated in FIGS. 14-16*d*.

The coupler produced using the mold 10 and method described herein. The coupler produced may include a shank selection option that utilizes the configuration of the type-E rear mold component section 14. A preferred weight reduction zone 80 is provided therein, so the coupler produced having a shank corresponding to the shank section 14 preferably is lighter in weight, yet suitably strong to meet or exceed the AAR standards for railcar couplers. According to some embodiments, the mold 10 may be constructed so that the walls have preferred thicknesses that will produce a coupler according to acceptable AAR standards. According to some preferred embodiments, the mold component rear section or shank may be constructed having maximum wall thicknesses of preferably less than about 1.6" and, more preferably, if ADI is used to produce a coupler from the mold 10, equal to or less than about 1.25" and preferably less than about 1.0" and, more preferably less than about 0.65" if austempered steel is used. The mold 10 preferably may be used to produce a coupler with wall thicknesses corresponding to the thicknesses of the mold walls.

The mold constructed to produce a coupler, such as the exemplary mold 10, and including mold component sections forming the mold, such as, for example, those mold component sections 11,12,13,14' forming the mold 10, preferably are made from a material that may readily decompose when contacted by the melt or other material that is used to form the resultant coupler. According to preferred embodiments, the mold 10 and mold components 11,12,1314' are formed from a decomposable material. According to a preferred embodiment, the mold components 11,12,13,14' are formed from a foam material. For example, one preferred material for forming the mold components 11,12,13,14' is a polystyrene foam. The mold 10, and mold sections forming the mold, such as those mold component sections 11,12,13,14' described herein in connection with a preferred embodiment, as well as the other mold sections shown and described herein in alternate embodiments that provide alternate selection options, may be made by injection molding. The mold material may be injection molded to form the desired mold shape that corresponds with the shape and volume of the coupler that is to be produced from the mold, such as, for example, the mold 10 used to produce the coupler 210. Alternatively, molds used to produce a coupler, such as the mold 10, may be formed by three dimensional (3-D) printing, where selection options for the mold components, or portions thereof, are made using a computer and software programmed with instructions to receive and display selection options for the components, and for assembling the components together in a desired arrangement to produce a mold. Alternative means may be used to form the mold 10. For example, the mold 10 may be formed using another mold (a mold form or die), such as, for example, a ceramic, plastic or aluminum mold form or die. Another way in which the mold material may be used to form the mold 10 and mold component sections 11,12,13,14' is by using pre-expanded beads of material, such as polystyrene, which are placed in the mold form or die and processed using steam and/or heat and air to form a foamed polystyrene mold 10. This may be accomplished by injecting the mold material in bead form into the mold form or die, heating the mold form or die with a heat source and, alternately or in addition thereto, applying steam to cause the material, such as polystyrene, to expand more to fill the die or mold form. According to preferred embodiments, the resultant mold 10 may be composed of as little as 3%, or even less, of the solid material, such as polystyrene, with the rest of the mold composition being air. According to preferred embodiments, the mold 10 is formed from a plurality of sections, such as those mold component sections 11,12,13,14' shown and described herein in connection with the preferred embodiment. The preferably foam mold sections may be separately produced and assembled together to form the mold 10. The mold sections may be glued together in their aligned form to provide a mold 10 that may be used to produce a coupler. In the case of alternate embodiments, the mold sections may be assembled together in their aligned form to form the mold that is a replica of the coupler to be produced by the application of adhesive, fusion, welding or other alternative assembly method. According to a preferred embodiment, the sections of the mold 10 may include components representing the portions of a coupler that may be customized to a particular selection, such as, for example, the production of a coupler having a particular shank. The coupler mold 10 may be configured to produce a coupler with a shank option by producing the shank portion of the mold 14' for example, and assembling that shank portion 14' with the other mold component portions (such as, for example, the head 13, upper shelf 11 and lower shelf 12, as depicted in FIGS. 17-19) to produce a coupler. According to alternate embodiments, other options and selections for the coupler head, shelves and shank may be provided to produce a coupler, including for example, the alternate shank options illustrated in FIGS. 14-16*d*.

The formed mold component sections, such as the mold component section 11,12,13,14', when arranged, form at least one, and, as shown in a preferred embodiment, a plurality of openings which enable communication into the mold cavities from outside the mold, as is illustrated with the exemplary embodiment of the mold 10. The mold component sections 11,12,13,14', according to the preferred arrangement illustrated, define the exterior surfaces of the mold 10 as well as the interior of the mold, including interior surfaces.

A coupler is produced from the mold constructed as shown and described herein. As discussed in connection with the exemplary embodiment, the mold 10 may be used to produce a coupler. According to a preferred method, the mold component sections 11,12,13,14' are assembled together in an aligned condition, and preferably are secured together (e.g., with a suitable adhesive or other means of assembly). A coating is applied to the mold 10 so that the interior and exterior mold surfaces are covered. Preferably the coating is a refractory coating. The coating is applied to the mold 10 in order to form a solid, shape-retaining composition. The coating may be applied by brushing, spraying immersing, or other suitable application procedure. The coating, once applied and cured on the mold 10, preferably has a melting point higher than that of the molten material that is to be introduced into the mold 10 to form the coupler. The mold 10 is constructed to permit permeability of the decomposed mold material or by products thereof. According to a preferred embodiment, the coating preferably is permeable to the decomposed mold component sections, when they decompose, or by products of the mold decomposition. The coating is suitably resistant to heat and the material to which the formed coupler is to be made, so that the coupler may be formed using the molten metal and the refractory coating is able to maintain the mold shape. One preferred example of a refractory coating is a ceramic coating. According to a preferred embodiment, the mold 10 is coated in its entirety, except possibly where fill locations are provided along the mold 10, or where any risers are located if they are utilized in connection with the filling of the mold 10.

Once the refractory coating has been applied to the mold component sections 11,12,13,14' of the assembled mold 10, the mold cavities are filled with an inert material, For example, according to the embodiment illustrated, the mold cavities, such as the mold cavities 27*a*,29*a* of the coupler guard arm portion 16 of the head or front mold component 13, the cavity 14*h'* in the shank 14' (FIG. 1) (or the cavity 79 in the shank 14), and the cavity 39 in the mold component head 13 (FIG. 3) are filled with an inert material. As shown in FIG. 1 and in the assembled mold 10 shown in FIGS. 17 and 18, a filling feature is provided for admitting the inert material, such as, for example, sand, into the mold 10, and preferably at a plurality of locations on the mold 10. The mold component shank 14' is shown having an opening 14*j'* provided in the top wall 14*d'* of the shank 14'. The opening 14*j'* preferably is elongated and provides a port for access to the mold interior, i.e., the cavity 14*h'* through which inert material (e.g., sand) may be admitted into the shank cavity 14*h'*. In addition, the filling feature includes a plurality of openings 14*k'*,14*l'*,14*m'*,14*n'*,14*o'*,14*p'* provided in the top wall 14*d'* of the shank 14' through which inert material or sand may be introduced into the mold 10, and in particular into the shank cavity 14*h'*. The shank cavity 14*h'* being in communication with the head cavity 39 may also facilitate sand filling of the front mold component or head 13. As shown in FIG. 17, additional sand filling openings are provided in the head portion 13, and include a nose opening 33*a*, a first head opening 13*a*, a second head opening 13*b* and a third head opening 13*c*. The nose opening 33*a* preferably may be used to admit the inert material or sand into the cavities 27*a*,29*a* of the guard arm portion 16. The head openings preferably admit inert material (e.g., sand) into the cavities of the head or front mold component 13. As shown in the bottom view in FIG. 18, additional head openings 13*d*,13*e*,13*f* are provided. The mold 10 also includes areas that include one or more openings through which inert material (e.g., sand) may be introduced, where the openings are formed in a wall of reduced thickness. For example, the top wall 13*g* of the front mold component or head 13 includes a plurality of openings 13*h*,13*i*,13*j* through which the inert material may be admitted to fill cavities in the head 13. In addition, openings 13*k*,13*l*,13*m*,13*n* are shown provided in a wall of reduced thickness to provide access to the front mold component cavities. Openings 14*q*',14*r*' in the back of the shank 14' are provided in a wall of reduced thickness, which preferably may be all or a portion of the top wall 14*d*'. Similar openings 14*s*',14*t*' are provided on the opposite wall 14*e*', which preferably is a wall of reduced thickness. Inert material also may be introduced into the shank 14' through the opening 14*u*' provided in the bottom wall 14*e*' opposite the top opening 14*j*'. In addition, preferably a plurality of openings 14*v*',14*w*',14*x*', 14*y*',14*z*',14*aa*' are provided on the shank bottom wall 14*e*' opposite those openings 14*k*',14*l*',14*m*',14*n*',14*o*',14*p*' in the top wall 14*d*'. The openings 27,29 in the respective guard arm top wall 28 and bottom wall 30, in addition to providing a zone of weight reduction, also provide access into the respective cavities 27*a*,29*a* within the guard arm 16 so as to fill the guard arm cavities 27*a*,29*a* with inert material (e.g., sand). Referring to FIG. 14, the alternate shank mold component 114 is shown having openings 114*a*,114*b* through which inert material may be admitted into the cavities of the shank portion of the mold. The shank openings 114*a*,114*b* may be provided in a wall of reduced thickness, similar to the shank mold component 14' shown and described herein. In addition, the shank mold component 114 is shown having a plurality of openings in its top wall 114*d*, which also may be used to admit inert material into the cavity (e.g., where the shank 114 has a cavity similar to the cavity 14*h*' shown and described in connection with the shank component 14'). The alternate type-F shank mold component 314 shown in FIG. 15*a* includes a plurality of openings, in particular, openings in the top wall 314*d* thereof, as well as a plurality of openings provided in the rear 314*r* of the shank component 314 that are arranged similar to the openings in the shank component 14 shown and described herein.

The inert material has a melting point higher than that of the material that will be used to form the coupler. A preferred inert material is sand. Once coated, the mold, such as the exemplary mold 10, may be placed in a suitable position, where it is secured, so that the sand may be introduced into the openings in the assembled mold 10 to fill the cavities. Referring to the mold 10 shown and described herein, one preferred way to introduce the sand into the cavities, involves orienting the mold 10 in a vertical position, with the head portion 13 of the mold 10 standing upright on the shank portion 14'. Alternatively, the mold 10 may be positioned in one or more alternate orientations where the sand may be introduced into the mold 10 to fill the cavities. Molds preferably may be constructed with openings so that the inert material (e.g., sand) may be admitted to the mold cavities from a plurality of location (openings) on the mold. The mold 10 may be placed in a holder, such as a jig, or a container surrounded by an inert material, such as sand. The fill material, such as sand, is then introduced to fill the mold cavities. Preferably, the sand is compacted to facilitate removal or minimization of air voids in the mold cavities. One way to accomplish this is to tamp the mold 10 or vibrate the mold 10 so that the sand will settle into the cavities. The mold 10 may be tamped or vibrated after sand is placed into the mold cavities, or as the sand is being introduced into the cavities. The introduction of sand into the mold cavities may be done with the aid of a vibration table, where the mold 10 is filled on, or placed on, a vibration table to compact the sand within the mold cavities.

Once the cavities of the mold 10 are filled with the inert material, such as sand, and the sand has been compacted, then the forming material or melt from which the coupler is to be constructed is introduced into the mold 10. The forming material preferably is introduced in a molten form. This may be accomplished by hand pouring the melt into the mold 10 or with the use of a filling machine that delivers the molten material to the mold 10. The molten forming material is introduced into the mold 10, and preferably is provided to contact the foam portion forming the mold, and to take up residence within the refractory coating. The forming material, preferably is added to the mold 10 in its molten form. The forming material preferably is provided to the mold 10 at or near one or more openings to the mold 10, which preferably are provided in the refractory coating, where the one or more openings lead to the foam mold 10. When the refractory coating is applied, preferably, at least one or more openings in the coating is provided to communicate with the mold 10 (and mold composition therein, e.g., foam) so that the melt may be introduced into the coated mold 10 to occupy the portions of the mold 10 that are to form the coupler. According to preferred embodiments, the openings and cavities that communicate therewith (which are those openings and cavities to be formed in the resultant coupler), generally, at this stage of the process are occupied by sand. According to one preferred method, the mold 10 is held in a vertical position, and the melt is introduced into the mold 10 at or near the front face 121 of the head 13. Alternatively, the filling may be done from the shank end portion 14, with the melt introduced at or near the shank 14. According to preferred embodiments, the melt may be introduced to the mold 10 at one or more locations, and preferably, the melt is introduced into the mold 10 so as to provide a suitable flow of material or melt so as to fill the entire volume of the mold 10 that is to constitute the coupler to be produced, without voids or vacancies otherwise forming in the mold volume, and, also so that the flow of material or melt within the mold volume does not prematurely solidify. This may involve introducing the material, such as the hot melt, into the mold at a plurality of locations so that the mold 10 may be filled with the forming composition at each of the mold locations. The mold 10 also may be supported in a container or tub of supporting material, such as sand stone or other material, which may be used to support the coated mold during the molten metal introduction and curing period after the molten metal has been admitted into the mold. The previously applied refractory coating of the coated mold 10 forms the mold exterior and the mold interior. The mold interior defines the cavities of the mold 10 (and of the resultant coupler). The introduction of the molten forming material contacts the mold 10 and the mold component sections 11,12,13,14' of which the mold 10 is comprised (which are between the refractory coating of the mold exterior and mold interior). The mold 10 and mold component sections 11,12,13,14' are decomposed when contacted by the forming material. The forming material fills the space between the coating that the mold component sections 11,12,13,14' occupied before contact with the melt. The forming material may be allowed to cure and set to form the coupler. The coupler formed in the mold 10 preferably is separated from the refractory coating, which may be done by breaking the coating. The formed coupler has the shape and volume of the mold 10 from which it was formed. The material used to form the coupler therefore takes the place of the mold component sections 11,12,13,14' to form a coupler that has a shape corresponding to that of the arranged mold component sections 11,12,13,14'.

According to one preferred embodiment, the forming material is treated by a treatment process, and preferably a process to strengthen the material, and to provide a suitable microstructure in the formed coupler. Preferably, the treatment process involves an austenitizing process, by which the formed coupler is an austempered material. For example, the forming of the coupler may involve applying a suitable austenitizing process to the coupler that is formed from the molding process. One preferred method involves separating the coupler product from the mold and heating the coupler product, such as, for example a ductile iron coupler product to an austenitizing temperature, and then quenching it, such as in a salt bath or other heat extraction composition. The austenitizing process may be applied to the coupler product once it has been produced using the mold 10. Alternatively, the coupler may be formed from steel or other suitable metal, including, for example, grade E steel traditionally used to form couplers.

Some other preferred examples of materials that may be used in accordance with the invention to form the coupler with the mold 10, include austempered metal, such as, for example, austempered ductile iron, austempered steel and austempered alloy steel, as well as alloys of these materials. Austempered ductile iron may include ductile iron alloyed with one or more metals, such as, for example, nickel, molybdenum, manganese, copper and mixtures thereof.

Once the forming material has been provided to fill the mold space, and any treatment such as austenitizing has taken place, the formed coupler is cured. The coupler formed is now between the refractory coating, which in on the interior of the coupler and on the exterior of the coupler. The inert material, such as sand, may still occupy the cavities (which are on the interior of the refractory coating). The formed coupler is then separated from the sand and the refractory coating. The configuration promotes the flow of sand not only into the mold cavities, but also out of the mold after use and out of the coupler, when formed. The sand occupying the cavities may be removed through one or more of the openings. The refractory coating (e.g., the ceramic) may be broken apart from the coupler to expose the coupler, which is a coupler that resembles the mold 10.

The method preferably permits the mold material to remain in its form, the mold 10 formed from the mold component sections 11,12,13,14' until the material forming the coupler is introduced into the mold 10 and to contact the mold material. The mold 10 and mold components 11,12, 13,14' preferably are allowed to remain in the ceramic enclosure created by coating the mold 10. According to a preferred embodiment of the process, the mold 10 does not require removal from the ceramic material, nor is there a separate bake-out step required to remove the mold 10. Rather, the material that is to form the coupler, such as molten metal or melt, is introduced into the mold 10 within the ceramic enclosure coating the mold 10, while the mold 10 (and mold component sections 11,12,13,14' from which the mold 10 is formed) remain present. The coating of the invention, for example, a refractory ceramic coating, is permeable to the decomposition by products of the mold composition. For example, the foamed polyethylene, when contacted with the molten metal of the forming composition (which is used to form the resultant coupler) melts and decomposes, forming a gaseous product. The gas exits the mold or coating. Accordingly, the present process is less time consuming, as the molten coupler forming material may be introduced into the mold 10 without requiring a removal step to remove the mold component sections 11,12, 13,14'. According to the invention, the coupler formed preferably has improved construction and surface characteristics, as the possibility of leaving behind material that is not removed from the mold is eliminated or greatly minimized.

Although not shown, an alignment mechanism, such as, for example, alignment elements may be provided on the mold sections to align the mold component sections 11,12, 13,14' together in a desired configuration. The alignment elements may include pins and holes provided at one or more locations on the mold component sections 11,12,13,14' and preferably on the contacting surfaces thereof, so that the pins will fit into the respective pin holes to ensure alignment of the mold component sections 11,12,13,14' in the desired shape of the coupler that is to be produced. The alignment elements preferably are provided in suitable locations on each respective component, so that regardless of the shank selection option made, and the head selection option, the head mold component or components may align with a shank mold component regardless of the shank mold component selected. According to a preferred embodiment, the alignment elements preferably are uniformly located on each of the mold components that are potential selections for combination with one or more other mold components.

According to an embodiment of the invention, an improved coupler 210 is provided. The improved coupler 210 may be constructed using the method illustrated and described herein, and may be produced using the mold 10 formed from mold component sections 11,12,13,14'.

The improved coupler 210 is illustrated in the drawing FIGS. 20-22 having substantially the same geometry as the mold 10 shown and described herein with which the coupler 210 may be produced, except that the coupler 210 is a single piece, with the coupler head 213, coupler shank 214', coupler top shelf 211 and coupler lower shelf 212 being formed from a continuous metal structure. As shown in FIGS. 20-22, the shank walls **214*d'*,214*e'*,214*f'*,214*g'* and 214*i'* are shown. The coupler 210 preferably has a weight reduction zone 280 in the shank portion 214' which includes elongated openings, including a first or upper elongated opening provided in the top wall 214*d'* (corresponding with the opening 14*j'* in the shank wall 14*d'* of the shank mold component 14' as shown in FIG. 17) and a second or lower opening provided in the opposite shank wall 214*e'*(corresponding with the opening 14*u'* in the lower shank wall 14*e'* of the shank mold component 14' as shown in FIG. 18). Preferably the coupler 214 includes a cavity' that extends from the front or head of the coupler 213, through the shank 214', the cavity portion in the shank 214' being identified as the cavity 214*h'* (corresponding with the mold component cavity 14*h'* (FIG. 1)), and the cavity portion in the coupler head 213 being identified as cavity 239 (corresponding with the cavity 39 of mold component portion 13 (FIG. 1**)).

The coupler 210 includes a force handling structure, which preferably has one or more transverse layers, such as the wall or layer 231, that span across the guard arm interior and separates the guard arm interior into cavities 227*a*,229*a*. Similar to the mold 10 shown and described herein, the coupler 210 has a plurality of interior cavities, including the guard arm cavities 227*a*,229*a*, which are formed by the top and bottom walls 228,230 and mid wall 231.

Embodiments of the coupler 210 preferably are constructed with a configuration that includes a openings provided in the shank 214', as shown and described in connection with the mold 10 and shank component 14'.

According to a preferred construction, the transverse rib or layer 231 provided in the guard arm 216 is provided along a path parallel to the anticipated force direction that the coupler 210 handles when a pulling force is applied to the coupler 210. The top wall 228 and lower wall 230 also support the guard arm 216 and the gathering wall 218.

According to some embodiments, couplers produced with the method of the present invention may be constructed having heights, lengths and widths similar to those of standard couplers, such as Type E and Type F couplers. According to some preferred embodiments, couplers may be constructed in accordance with the invention having preferred dimensions. The method preferably may be implemented to produce couplers having improved surface finishes to contribute to providing higher fatigue strength for the coupler. For example, the method may be used to produce a coupler with a surface finish of about 125-250 RMS. According to a preferred embodiment, the mold may be used to produce a coupler from ADI. Preferred embodiments of the mold 10 preferably have wall thicknesses from between about ¼ inch to about 1¼ inches, and produce a coupler with wall thicknesses corresponding to those of the mold walls. Preferred couplers produced from the mold preferably have wall thicknesses from between about ¼ inch to about 1¼ inches, and preferably are constructed from ADI. According to some preferred embodiments, couplers may be constructed having wall thicknesses preferably less than about 1.6" and, more preferably, if ADI is used to produce a coupler from the mold 10, equal to or less than about 1.25" and preferably less than about 1" and, more preferably less than about 0.65" if austempered steel is used. In addition, according to some preferred embodiments, the couplers may be produced having some or all of the advantages discussed herein and meet or exceed the AAR specification, M-216.

Although the embodiments are shown depicting a head and alternate embodiments for the coupler shank, according to the invention a coupler system and production system is provided where a coupler may be produced based on selected options for the coupler shape. The coupler system may include a plurality of selections for the upper and lower coupler shelves, selections for the coupler head as well as selections for the coupler shank. The mold for producing the coupler is produced in accordance with the selections. For example, according to a preferred embodiment, the lightweight shank with the weight reduction zone may be selected for use to produce a coupler by constructing a mold that has a coupler head, and one or more shelves, and utilizes the coupler shank having the weight reduction configuration. Alternatively, the coupler head may be formed with the mold component front part 13, and an alternate coupler shank and alternate shelves may be selected, and the mold constructed to have the features provided in the head and guard arm portion of the head mold component.

These and other advantages may be realized with the present invention. While the invention has been described with reference to specific embodiments, the description is illustrative and is not to be construed as limiting the scope of the invention. For example, although the method and mold refer to gaseous by products exiting the mold through the refractory coating, the mold by products may exit the mold through the openings formed in the mold and mold component sections. The mold design preferably allows the inert material or sand to flow through the mold so that the cavities may be filled to produce the coupler and emptied after the component has been formed. Preferred embodiments provide communicating cavities in the mold. The coupler mold components may be provided as four components, as described, or alternately may be greater or fewer numbers of components that may be assembled to produce the coupler. For example, although the front mold component is shown and described to resemble the coupler head, according to an alternate mold configuration, the coupler head may be formed from a plurality of mold component sections that may be joined together to form the mold. For example, the coupler guard arm may be provided as a separate mold component that may be assembled together with one or more additional mold components to form the coupler head, which in turn may be assembled with a shank mold component and shelf mold components to form the coupler mold. In addition, although the drawing figures of the mold 10 illustrate a type-E coupler mold formed from foam, alternatively, in accordance with one or more alternate embodiments, a type-F coupler head may be utilized and replace the type-E head of the mold 10 shown and described herein. For example, the shank portion of a coupler formed with the mold and mold components shown and described herein may be provided in a number of alternate configurations, even in addition to those depicted herein, that may be selected for use with a coupler head to form a selectively configured coupler. Accordingly, a shank mold component may be selected and combined with a selected coupler head mold component (with an optional selected upper shelf and lower shelf) to produce a coupler mold that may be used to produce a coupler having the desired shape for the head shank and other selected portions thereof (e.g., shelves). A number of different coupler shanks (e.g., up to or even greater than twenty different shanks) may be paired with a coupler head (e.g., a type-E head or type-F head) to allow versatility in forming a mold and producing couplers. For example, among the types of shanks that may be made available for selection for implementation as the mold shank to be paired with a coupler head, include, for example, rotary car shanks as well as shanks for locomotive applications. The step of constructing the mold preferably includes selecting from a plurality of coupler mold component configuration options a selected part option. According to one embodiment, a first selection of a coupler head is made from a plurality of coupler head mold component options (e.g., one or more type-E coupler heads may be provided for selection, and one or more type-F coupler heads may be provided for selection). In addition to selecting a coupler head, a coupler shank from one of a plurality of coupler shank mold component options is selected (e.g., from one of up to twenty or greater shank selections, e.g., rotary, locomotive, and the like). The coupler top shelf and bottom shelf, if desired for a coupler being produced, also are selected from one or more selections provided for each of these respective components. The method of producing a coupler in addition to constructing a replica, such as for example, a mold (e.g., a foam mold) representing the shape and volume of the coupler to be produced and producing the coupler as shown and described herein, according to some preferred embodiments, also includes selecting coupler configuration options for the mold and the coupler to be produced. The configuration options include a coupler head configuration, a coupler shank configuration, and optionally, also may include coupler shelf configurations. The method may be implemented by making selections of the coupler components desired for the resultant coupler, producing a mold as shown and described herein that corresponds with the selected shapes and volumes for those coupler components, assembling the mold by securing the components together, and using the mold to produce a coupler having those selected configuration options in an integral coupler. Although the mold component sections are discussed and shown referring to assembling the head and shank sections together, or shank sections to form a shank and head sections to form a head (where a shank or head itself is formed from multiple sections), the mold component sections that are assembled to form a mold, may be assembled in any order. For example, where a shank component is formed from a plurality of components and a head component is formed from a plurality of components, a head component section may be connected with a shank component section, and then connected to one or more other shank component sections and/or one or more other head component sections.

Various modifications and changes may occur to those skilled in the art without departing from the spirit and scope of the invention described herein and as defined by the appended claims. According to preferred embodiments of the invention, lightweight couplers may be constructed from grade E steel, such as for example, couplers configured with the coupler rear section where a weight reduction zone is provided to reduce the weight of the coupler. According to other preferred embodiments, lightweight couplers, including the coupler 210, and, including, in addition thereto, couplers configured with a construction of weight reduction zones as disclosed in connection with the coupler shank section and the coupler head, may be constructed from an austempered metal, preferably austempered steel, austempered ductile iron, austempered steel alloy or austempered ductile iron alloy. Preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used in conjunction with the method depicted and described herein to form the couplers as discussed and shown herein. The steel or preferred/more preferred alloy steel composition is austempered to obtain tensile strength, yield, and elongation properties for the inventive couplers which are suitable to meet or exceed the AAR standards for couplers, including the current standard set forth by the American Association of Railroads (AAR) in AAR Manual of Standards and Recommended Practices, such as current standard M-211, M-205, M-220 NDT and Rule 88 of the AAR Office Manual, the complete contents of which are herein incorporated by reference. Couplers may be constructed from ductile iron that is austempered. The ductile iron also may be used in alloy form, preferably, with nickel, molybdenum, manganese, copper, or mixtures thereof, to form couplers. According to preferred embodiments, the coupler is produced and subjected to an austenitizing process, which involves heating the ductile iron coupler to an austenitizing temperature, followed by quenching, such as in a salt bath or other heat extraction composition.

Lightweight couplers may be produced using the improved coupler configurations disclosed and shown herein. In addition, lightweight couplers are constructed from austempered ductile iron, austempered ductile iron alloy, austempered steel, and/or austempered steel alloy, in accordance with the invention, to provide couplers that are lighter in weight than prior couplers yet possesses suitable strength, yield and fatigue resistant properties that meet or exceed AAR testing and standards requirements set forth by the American Association of Railroads (AAR) in AAR Manual of Standards and Recommended Practices, and in Rules of the AAR Office Manual, the compete contents of which are herein incorporated by reference.

It is intended that the foregoing detailed description be regarded as illustrative rather than limiting, and that it be understood that it is the following claims, including all equivalents, that are intended to define the spirit and scope of this invention. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A method for producing a coupler comprising:

selecting a plurality of mold component sections which when assembled together replicate the configuration of the coupler to be produced; and assembling together the selected mold component sections to form a replica of the coupler to be produced;

wherein said mold has a plurality of mold component sections including at least one front mold component section corresponding with the shape of the coupler head and at least one rear mold component section corresponding with the shape of the coupler shank, wherein said front mold component section and said rear mold component section each include a cavity therein, and wherein said front mold component section cavity and said rear mold component section cavity communicate when said mold sections are assembled together.

2. The method of claim 1, including coating the assembled together mold component sections with a coating.

3. The method of claim 2, including adding molten metal to the coated mold in the locations of the assembled together mold components within the coated mold.

4. The method of claim 3, wherein said coupler is formed from an austempered metal.

5. The method of claim 4, wherein said austempered metal is austempered ductile iron.

6. The method of claim 5, wherein said austempered metal is selected from the group consisting of austempered ductile iron, austempered steel and austempered alloy steel.

7. The method of claim 6, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said coupler.

8. The method of claim 2, wherein the assembled mold component sections define an interior mold surface formed therefrom, and wherein the assembled mold component sections define an exterior mold surface formed therefrom, wherein said at least one cavity is formed by the interior mold surface;

wherein coating the assembled mold component sections comprises applying a refractory coating the interior and the exterior mold surfaces of said arranged mold component sections to form the mold to define a mold volume between said coated interior and said coated exterior surfaces;

introducing a molten metal into the mold volume.

9. The method of claim 8, including placing said mold formed from said coated and assembled mold component sections in a secured arrangement prior to introducing a molten metal into the mold volume.

10. The method of claim 9, wherein said secure arrangement comprises a container filled with sand.

11. The method of claim 8, wherein said mold formed from said mold component sections has at least one cavity therein and at least one opening therein;

wherein said at least one cavity communicates with the exterior of the mold through at least one opening, and wherein at least one cavity is located outside of the mold volume.

12. The method of claim 11, wherein said mold component sections are formed from a consumable material.

13. The method of claim 12, wherein introducing said molten metal into the mold volume consumes the mold component sections; and wherein said molten metal takes the place of said mold component sections in said mold volume to form a coupler having a shape that replicates the shape of the assembled mold component sections.

14. The method of claim 13, wherein said refractory coating is permeable to the consumed mold component sections or by products thereof.

15. The method of claim 12, wherein said consumable material is a decomposable material, and wherein introducing the molten metal into the mold volume contacts the mold component sections with said molten metal and decomposes the mold sections.

16. The method of claim 12, wherein said consumable material is consumed prior to the introduction of the molten metal into the mold volume.

17. The method of claim 12, wherein said consumable material is consumed by the introduction of the molten metal into the mold volume.

18. The method of claim 11, including introducing a first material into the at least one cavity to occupy the at least one cavity.

19. The method of claim 18, wherein said first material is an inert material.

20. The method of claim 19, wherein said inert material is sand.

21. The method of claim 18, including compacting the first material introduced into the at least one cavity.

22. The method of claim 21, wherein compacting is done by vibrating the mold and/or first material contained in the mold cavity.

23. The method of claim 18, wherein said mold formed from said mold component sections has a plurality of cavities therein and at least one or more openings therein that communicate with the exterior of the mold, wherein each cavity of said plurality of cavities is located outside of the mold volume;

including introducing an inert material into said plurality of cavities.

24. The method of claim 18, wherein said first material introduced into said at least one cavity is separated from contact with said assembled mold component sections in said mold volume by said refractory coating.

25. The method of claim 24, wherein said molten metal is separated from said first material introduced into said at least one cavity by said refractory coating.

26. The method of claim 11, wherein the first material is resistant to heat and has a melting point higher than that of the molten metal introduced into the mold to form the coupler.

27. The method of claim 8, wherein said mold formed from said mold component sections has at least one cavity therein and at least one opening therein;

wherein said at least one cavity communicates with the exterior of the mold through at least one opening, and wherein at least one cavity is located outside of the mold volume;

introducing a first material into the at least one cavity to occupy the at least one cavity;

wherein forming the coupler from the molten metal includes allowing the molten metal to cure to form a product, separating the first material, the cured second material product and refractory coating.

28. The method of claim 8, wherein coating comprises applying a refractory coating, and wherein said refractory coating is applied to form a solid, shape retaining composition that has a melting point higher than that of the molten metal that is introduced into the mold volume to form the coupler.

29. The method of claim 28, wherein said refractory coating is ceramic.

30. The method of claim 1, including determining a configuration for a coupler to be produced.

31. The method of claim 1, wherein said mold component sections include alignment means for aligning the mold component sections together in a desired configuration.

32. The method of claim 1, wherein said mold component sections are formed by injection molding.

33. The method of claim 1, wherein said mold component sections are formed from a foam material.

34. The method of claim 33, wherein said mold component sections are formed from polystyrene foam.

35. The method of claim 1, wherein said mold further comprises at least one or more of an upper shelf mold component section and a lower shelf mold component section.

36. A coupler produced in accordance with the method of claim 1.

37. A mold for producing a coupler comprising the replica of the coupler formed from the assembled mold component sections of claim 1, the mold comprising a plurality of mold component sections including at least one front mold component section corresponding with the shape of the coupler head and at least one rear mold component section corresponding with the shape of the coupler shank, wherein said front mold component section and said rear mold component section each include a cavity therein, and wherein said front mold component section cavity and said rear mold component section cavity communicate when said mold sections are assembled together.

38. The mold of claim 37, wherein the plurality of mold component sections include alignment elements which when aligned together align the mold components to form the shape of the coupler to be produced.

39. The method of claim 1, wherein the plurality of mold component sections include alignment elements, and wherein assembling includes aligning mold component section alignment elements together.

40. A method for producing a coupler comprising:

selecting a plurality of mold component sections which when assembled together replicate the configuration of the coupler to be produced; and assembling together the selected mold component sections to form a replica of the coupler to be produced;

wherein said mold component sections include at least one front mold component section corresponding with the shape of the coupler head and at least one rear mold component section corresponding with the shape of the coupler shank;

wherein the method includes providing a first plurality of selection options from which to select the configuration of the front mold component corresponding with the shape of the coupler head, and providing a second plurality of selection options from which to select the configuration of the rear mold component corresponding with the shape of the coupler shank;

wherein arranging the plurality of mold component sections to form the shape of the coupler to be produced includes arranging the front mold component with the rear mold component; and wherein said coupler having a shape corresponding with the arranged mold component sections is a coupler formed having a coupler head shape of the selected head option and a coupler shank shape of the selected shank option.

41. The method of claim 40, including coating the assembled together mold component sections with a coating.

42. The method of claim 41, including adding molten metal to the coated mold in the locations of the assembled together mold components within the coated mold.

43. The method of claim 42, wherein said coupler is formed from an austempered metal.

44. The method of claim 43, wherein said austempered metal is austempered ductile iron.

45. The method of claim 44, wherein said austempered metal is selected from the group consisting of austempered ductile iron, austempered steel and austempered alloy steel.

46. The method of claim 45, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said coupler.

47. The method of claim 41, wherein the assembled mold component sections define an interior mold surface formed therefrom, and wherein the assembled mold component sections define an exterior mold surface formed therefrom, wherein said at least one cavity is formed by the interior mold surface;

wherein coating the assembled mold component sections comprises applying a refractory coating the interior and the exterior mold surfaces of said arranged mold component sections to form the mold to define a mold volume between said coated interior and said coated exterior surfaces;

introducing a molten metal into the mold volume.

48. The method of claim 47, including placing said mold formed from said coated and assembled mold component sections in a secured arrangement prior to introducing a molten metal into the mold volume.

49. The method of claim 48, wherein said secure arrangement comprises a container filled with sand.

50. The method of claim 47, wherein said mold formed from said mold component sections has at least one cavity therein and at least one opening therein;

wherein said at least one cavity communicates with the exterior of the mold through at least one opening, and wherein at least one cavity is located outside of the mold volume.

51. The method of claim 50, wherein said mold component sections are formed from a consumable material.

52. The method of claim 51, wherein introducing said molten metal into the mold volume consumes the mold component sections; and wherein said molten metal takes the place of said mold component sections in said mold volume to form a coupler having a shape that replicates the shape of the assembled mold component sections.

53. The method of claim 52, wherein said refractory coating is permeable to the consumed mold component sections or by products thereof.

54. The method of claim 51, wherein said consumable material is a decomposable material, and wherein introducing the molten metal into the mold volume contacts the mold component sections with said molten metal and decomposes the mold sections.

55. The method of claim 51, wherein said consumable material is consumed prior to the introduction of the molten metal into the mold volume.

56. The method of claim 51, wherein said consumable material is consumed by the introduction of the molten metal into the mold volume.

57. The method of claim 50, including introducing a first material into the at least one cavity to occupy the at least one cavity.

58. The method of claim 57, wherein said first material is an inert material.

59. The method of claim 58, wherein said inert material is sand.

60. The method of claim 57, including compacting the first material introduced into the at least one cavity.

61. The method of claim 60, wherein compacting is done by vibrating the mold and/or first material contained in the mold cavity.

62. The method of claim 57, wherein said mold formed from said mold component sections has a plurality of cavities therein and at least one or more openings therein that communicate with the exterior of the mold, wherein each cavity of said plurality of cavities is located outside of the mold volume;

including introducing an inert material into said plurality of cavities.

63. The method of claim 57, wherein said first material introduced into said at least one cavity is separated from contact with said assembled mold component sections in said mold volume by said refractory coating.

64. The method of claim 63, wherein said molten metal is separated from said first material introduced into said at least one cavity by said refractory coating.

65. The method of claim 40, including determining a configuration for a coupler to be produced.

66. The method of claim 40, wherein said mold component sections include alignment means for aligning the mold component sections together in a desired configuration.

67. The method of claim 40, wherein said mold component sections are formed by injection molding.

68. The method of claim 40, wherein said mold component sections are formed from a foam material.

69. The method of claim 68, wherein said mold component sections are formed from polystyrene foam.

70. The method of claim 50, wherein the first material is resistant to heat and has a melting point higher than that of the molten metal introduced into the mold to form the coupler.

71. The method of claim 40, wherein said mold further comprises at least one or more of an upper shelf mold component section and a lower shelf mold component section.

72. A coupler produced in accordance with the method of claim 40.

73. A mold for producing a coupler comprising the replica of the coupler formed from the assembled mold component sections of claim 40, the mold comprising a plurality of mold component sections including at least one front mold component section corresponding with the shape of the coupler head and at least one rear mold component section corresponding with the shape of the coupler shank, wherein said front mold component section and said rear mold component section each include a cavity therein, and wherein said front mold component section cavity and said rear mold component section cavity communicate when said mold sections are assembled together.

74. The mold of claim 73, wherein the plurality of mold component sections include alignment elements which when aligned together align the mold components to form the shape of the coupler to be produced.

75. The method of claim 40, wherein the plurality of mold component sections include alignment elements, and wherein assembling includes aligning mold component section alignment elements together.

76. The method of claim 47, wherein said mold formed from said mold component sections has at least one cavity therein and at least one opening therein;

wherein said at least one cavity communicates with the exterior of the mold through at least one opening, and wherein at least one cavity is located outside of the mold volume;

introducing a first material into the at least one cavity to occupy the at least one cavity;

wherein forming the coupler from the molten metal includes allowing the molten metal to cure to form a product, separating the first material, the cured second material product and refractory coating.

77. The method of claim 47, wherein coating comprises applying a refractory coating, and wherein said refractory coating is applied to form a solid, shape retaining composition that has a melting point higher than that of the molten metal that is introduced into the mold volume to form the coupler.

78. The method of claim 77, wherein said refractory coating is ceramic.

* * * * *